US006143485A

United States Patent [19]

Tang et al.

[11] Patent Number: 6,143,485

[45] Date of Patent: Nov. 7, 2000

[54] PYRAZOLOTRIAZLE DYE-FORMING PHOTOGRAPHIC COUPLER

[75] Inventors: Ping-Wah Tang, Yorktown Heights; Stanley W. Cowan, Rochester, both of N.Y.

[73] Assignee: Eastman Kodak Company, Rochester, N.Y.

[21] Appl. No.: 09/219,473

[22] Filed: Dec. 23, 1998

[51] Int. Cl.[7] ..... G03C 1/08; G03C 7/26; G03C 7/32

[52] U.S. Cl. ..... 430/558; 430/386; 430/387

[58] Field of Search ..... 430/558, 543, 430/386, 387

[56] References Cited

U.S. PATENT DOCUMENTS

| | | | |
|---|---|---|---|
| 4,621,046 | 11/1986 | Sato et al. . | |
| 4,840,886 | 6/1989 | Iijima et al. | 430/558 |
| 5,234,805 | 8/1993 | Tang et al. | 430/558 |
| 5,378,587 | 1/1995 | Krishnamurthy et al. . | |
| 5,576,150 | 11/1996 | Tang et al. | 430/558 |
| 5,578,437 | 11/1996 | Asami et al. | 430/558 |
| 5,597,679 | 1/1997 | Yoshioka | 430/558 |
| 5,667,952 | 9/1997 | Tang et al. | 430/558 |

FOREIGN PATENT DOCUMENTS

| | | |
|---|---|---|
| 0571959 | 7/1987 | European Pat. Off. . |

*Primary Examiner*—Geraldine Letscher
*Attorney, Agent, or Firm*—Arthur E. Kluegel

[57] ABSTRACT

A color photographic film or paper comprises at least one silver halide emulsion layer having associated therewith a dye-forming coupler compound of the formula (I)

wherein:

one of $Z_a$ and $Z_b$ is —N=and the other is to which ring "A" is directly attached;

$R^0$ represents hydrogen or a substituent;

$R^1$, $R^2$, $R^3$, and $R^4$ independently represent hydrogen or substituents, provided that any two $R^1$ groups, any two $R^4$ groups or $R^2$ and $R^3$ may form a ring;

L represents a divalent linking group;

B represents a substituted or unsubstituted sulfonamido or sulfamoyl group;

D represents a substituted or unsubstituted alkyl, aryl carbocyclic or heterocyclic group;

X represents hydrogen or a coupling-off group;

p and m represent integers from 0 to 4; and n represents 0 or 1.

10 Claims, No Drawings

PYRAZOLOTRIAZLE DYE-FORMING PHOTOGRAPHIC COUPLER

FIELD OF THE INVENTION

The present invention relates to pyrazolotriazole dye-forming couplers and to photographic silver halide materials containing such couplers.

BACKGROUND OF THE INVENTION

Many color photographic silver halide materials, i.e., color negative films and color prints, today are processed in automated, rapid processing machines popularly known as "mini labs." These processing systems have been developed with the goal of making high-quality prints in the shortest possible time, and typically produce dry prints in 4 minutes or less. The achievement of this goal requires photographic film and papers containing essentially pure silver chloride emulsions and dye-forming couplers that react rapidly and efficiently with the oxidation products of the p-phenylenediamine color developing agents to form the desired image dyes.

In addition to this requirement for high reactivity, the couplers and the dyes derived from them must satisfy requirements for hue and, especially for color papers, stability to light, heat, and humidity, to produce color prints that accurately reproduce the colors of the subjects and do not fade during long-term storage under a wide variety of conditions.

European Patent 571,959 discloses a 1H-pyrazolo[1,5-b][1,2,4]triazole magenta coupler having at the 6-position of the fused ring system a tertiary alkyl group. The presence of this tertiary alkyl group effects a marked improvement in the stability of the image dye to light. However, the disclosed couplers do not have sufficient coupling efficiency for modern rapid processing systems.

U.S. Pat. No. 5,578,437 discloses a 1H-pyrazolo[1,5-b][1,2,4]triazole magenta coupler exemplified by the following structure that is capable of rapid processing and produces an image dye with excellent stability to light. However, the coupling efficiency of this coupler, while improved over some prior art couplers, desirably would be greater for the most rapid processing systems.

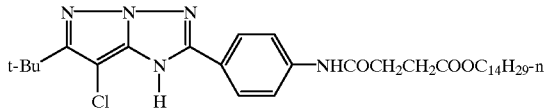

Coupler M-1 in U.S. Pat. No. 5,578,437

It is therefore a problem to be solved to provide a pyrazolotriazole coupler with improved coupling efficiency, which does not sacrifice the necessary image dye properties of excellent hue and, when used in color papers, stability to light, heat, and humidity.

SUMMARY OF THE INVENTION

These requirements are fulfilled by the compounds of the present invention, which are represented by Formula (I), (I)

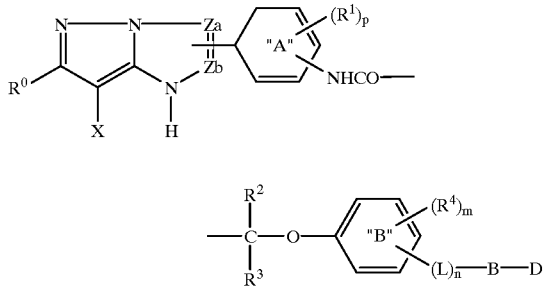

wherein:

one of $Z_a$ and $Z_b$ is —N=and the other is

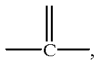

to which ring "A" is directly attached;

$R^0$ represents hydrogen or a substituent;

$R^1$, $R^2$, $R^3$ and $R^4$ independently represent hydrogen or substituents, provided that any two $R^1$ groups, any two $R^4$ groups or $R^2$ and $R^3$ may form a ring;

L represents a divalent linking group;

B represents a substituted or unsubstituted sulfonamido or sulfamoyl group,

D represents a substituted or unsubstituted alkyl, aryl, carbocyclic or heterocyclic group;

X represents hydrogen or a coupling-off group;

p and m independently represent integers from 0 to 4; and n represents 0 or 1.

The invention also provides a novel color photographic element comprising support bearing at least one photographic silver-halide emulsion layer having associated therewith a dye-forming coupler compound of Formula (I).

The novel dye-forming coupler compounds of Formula (I) exhibit superior coupling efficiency in reacting with oxidized color developer during processing of the silver halide photographic materials of the invention to form image dyes. In preferred embodiments of the coupler compounds, the resulting dyes, which normally are magenta dyes, have superior light stability and are useful in color photographic papers.

DETAILED DESCRIPTION OF THE INVENTION

As shown by the generic formula (I), the coupler compounds of the invention include two isomeric structures of ballasted pyrazolotriazole compounds, namely those of Formula (Ia) and Formula (Ib):

(Ia)

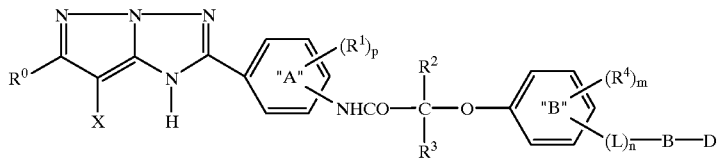

and (Ib)

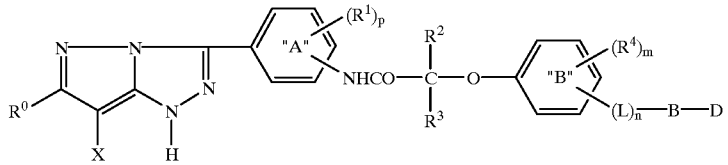

wherein the various substituents and symbols are as defined for Formula (I) above.

As the above formulae (I), (Ia) and (Ib) show, the compounds of the invention are characterized by the fact that the amido-substituted aromatic ring "A" of the ballast group is attached directly to the pyrazolotriazole coupler radical without an intervening linking group as in previously published compounds. Thus, in U.S. Pat. No. 5,234,805 and in U.S. Pat. No. 5,378,587 a methylene group and/or other divalent linking groups connect the ballast group to the pyrazolotriazole radical. In accordance with the present invention it has been discovered that the novel pyrazolotriazole compounds in which the ballast radical is attached by aryl ring "A" directly to the pyrazolotriazole group, and in which a sulfonamido or sulfamoyl group is attached directly or through a linking group to aryl ring "B"). provide a remarkable improvement in photographic dye coupling activity.

An additional benefit in superior light stability of the resulting dyes is also obtained when the substituent $R^0$ of the pyrazolotriazole compound of Formula (I) is a tertiary alkyl group, most preferably, t-butyl or t-octyl, or a multicarbocyclic or multiheterocyclic group bonded to the rest of the compound by a carbon atom forming the vertex of two or more rings. Such light stability is important when the photographic element of the invention is a photographic paper having a reflective support and is especially important when the element is a professional portrait paper which is likely to be used to form prints that will be exposed to light over long periods of time.

An important characteristic of the compounds of the invention is that Ring "A" is directly bonded to a ring carbon atom of the pyrazolotriazole radical, with no intervening linking groups. Also important is the presence of ring "B" with its sulfonamido or sulfamoyl substituent. This novel structural combination, including rings "A" and "B" and the groups attached to them, is believed to contribute markedly to the excellent coupling activity of the compounds of the invention.

When used in photographic materials not intended for lengthy exposure to light, such as color negative films, light stability of dyes formed by couplers of the invention is less important. In such cases $R^0$ preferably is a methyl group. Other factors may influence the choice of $R^0$; for example, an electron withdrawing group in this position, especially in combination with one or more electron withdrawing substituents on ring "A", will cause the coupler to form a cyan dye instead of a magenta dye, Hence, for such materials $R^0$ in the coupler compounds of the invention can be selected from hydrogen and a wide range of substitutents, including ones that are desirable for other properties. Such other substituents suitable as $R^0$ are described hereinafter in the discussion of the term "substitutent."

$R^1$, $R^2$, $R^3$ and $R^4$ independently represent hydrogen or substituents, as hereinafter defined, however, when p or m is 2, 3 or 4 any two $R^1$ substituents or any two $R^4$ substituents may form a ring. Likewise, $R^2$ and $R^3$ may form a ring.

In preferred compounds of Formula (I), $R^1$ is hydrogen, alkyl, aryl, alkoxy or halogen; $R^2$ is hydrogen; $R^3$ is alkyl, most preferably of 2 to 14 carbon atoms; and $R^4$ is hydrogen, alkyl, aryl, alkoxy or halogen or two $R^4$ groups on adjacent carbon atoms form a fused benzene ring.

In Formula (I), B is a substituted or unsubstituted sulfonamido or sulfamoyl group and D represents a substituted or unsubstituted alkyl, aryl, carbocyclic or heterocyclic group. D preferably is lower alkyl, phenyl, alkylsulfonamidophenyl or p-hydroxyphenyl and, most preferably, is butyl or p-alkylsulfonamidophenyl. Preferably, B is —$N(R^5)SO_2$—, where $R^5$ is hydrogen or a substituent and, most preferably, is —$NHSO_2$—.

X in Formula (I) is hydrogen, halogen or a coupling-off group, as hereinafter defined. Preferably X is halogen or aryloxy and, most preferably is chlorine.

Unless otherwise specifically stated, use of the term "substituted" or "substituent" means the presence or absence of any group or atom other than hydrogen. Additionally, when the term "group" is used, it means that when a substituent group contains a substitutable hydrogen, it is also intended to encompass not only the substituent's unsubstituted form, but also its form further substituted with any substituent group or groups as herein mentioned, so long as the substituent does not destroy properties necessary for photographic utility. Suitably, a substituent group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight or branched chain or cyclic alkyl, such as methyl, trifluoromethyl, ethyl, t-butyl, 3-(2,4-di-t-pentylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy)ethoxy, and 2-dodecyloxyethoxy; aryl such as phenyl, 4-t-butylphenyl, 2,4,6-trimethylphenyl, naphthyl;

aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentyl-phenoxy)acetamido, alpha-(2,4-di-t-pentylphenoxy)butyramido, alpha-(3-pentadecylphenoxy)-hexanamido, alpha-(4-hydroxy-3-t-butylphenoxy)-tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl)carbonylamino, p-dodecyl-phenylcarbonylamino, p-tolylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-tolylureido, N-(m-hexadecylphenyl)ureido, N,N-(2,5-di-i-pentylphenyl)-N'-ethylureido, and t-butylcarbonamido; sulfonamido, such as methylsulfonamido, benzenesulfonamido, p-tolylsulfonamido, p-dodecylbenzenesulfonamido, N-methyltetradecylsulfonamido, N,N-dipropyl-sulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl. phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-tolylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-tolylsulfinyl; thio, such as ethylthio, octylthio, benzylthio, tetradecylthio, 2-(2,4-di-t-pentylphenoxy)ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1-(N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc. When a molecule may have two or more substituents, the substituents may be joined together to form a ring such as a fused ring unless otherwise provided. Generally, the above groups and substituents thereof may include those having up to 48 carbon atoms, typically 1 to 36 carbon atoms and usually less than 24 carbon atoms, but greater numbers are possible depending on the particular substituents selected.

The materials of the invention can be used in any of the ways and in any of the combinations known in the art. Typically, the coupler compounds are incorporated in a melt and coated as a layer described herein on a support to form part of a photographic element. When the term "associated" is employed, it signifies that a reactive compound is in or adjacent to a specified layer where, during processing, it is capable of reacting with other components.

To control the migration of various components, it may be desirable to include a high molecular weight hydrophobe or "ballast" group in coupler molecules. Representative ballast groups include substituted or unsubstituted alkyl or aryl groups containing 8 to 48 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido, carbamoyl, alkylsulfonyl, arylsulfonyl, sulfonamido, and sulfamoyl groups wherein the substituents typically contain 1 to 42 carbon atoms. Such substituents can also be further substituted.

The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

If desired, the photographic element can be used in conjunction with an applied magnetic layer as described in *Research Disclosure,* November 1992, Item 34390 published by Kenneth Mason Publications, Ltd., Dudley Annex, 12a North Street, Emsworth, Hampshire P0107DQ, ENGLAND, and as described in Ilatsumi Kyoukai Koukai Gihou No. 94-6023, published Mar. 15, 1994, available from the Japanese Patent Office, the contents of which are incorporated herein by reference. When it is desired to employ the inventive materials in a small format film, *Research Disclosure,* June 1994, Item 36230, provides suitable embodiments.

In the following discussion of suitable materials for use in the emulsions and elements of this invention, reference will be made to *Research Disclosure,* September 1996, Item 38957, available as described above, which is referred to herein by the term "Research Disclosure". The contents of the Research Disclosure, including the patents and publications referenced therein, are incorporated herein by reference, and the Sections hereafter referred to are Sections of the Research Disclosure.

Except as provided, the silver halide emulsion containing elements employed in this invention can be either negative-working or positive-working as indicated by the type of processing instructions (i.e. color negative, reversal, or direct positive processing) provided with the element. Suitable emulsions and their preparation as well as methods of chemical and spectral sensitization are described in Sections I through V. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and VI through VIII. Color materials are described in Sections X through XIII. Suitable methods for incorporating couplers and dyes, including dispersions in organic solvents, are described in Section X(E). Scan facilitating is described in Section XIV. Supports, exposure, development systems, and processing methods and agents are described in Sections XV to XX. The information contained in the September 1994 *Research Disclosure,* Item No. 36544 referenced above, is updated in the September 1996 *Research Disclosure,* Item No. 38957. Certain desirable photographic elements and processing steps, including those useful in conjunction with color reflective prints, are described in *Research Disclosure,* Item 37038, February 1995.

Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like.

The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in UK. Patents and published application Nos. 1,466,728, 1,531,927, 1,533,039, 2,006,755A and 2,017,704A, the disclosures of which are incorporated herein by reference.

Image dye-forming couplers may be included in the element such as couplers that form cyan dyes upon reaction with oxidized color developing agents which are described in such representative patents and publications as: "Farbkuppler-eine Literature Ubersicht," published in Agfa Mitteilungen, Band III, pp. 156–175 (1961) as well as in U.S. Pat. Nos. 2,367,531; 2,423,730; 2,474,293; 2,772,162; 2,895,826; 3,002,836; 3,034,892; 3,041,236; 4,333,999; 4,746,602; 4,753,871; 4,770,988; 4,775,616; 4,818,667; 4,818,672; 4,822,729; 4,839,267; 4,840,883; 4,849,328; 4,865,961; 4,873,183; 4,883,746; 4,900,656; 4,904,575; 4,916,051; 4,921,783; 4,923,791; 4,950,585; 4,971,898; 4,990,436; 4,996,139; 5,008,180; 5,015,565; 5,011,765; 5,011,766; 5,017,467; 5,045,442; 5,051,347; 5,061,613; 5,071,737; 5,075,207; 5,091,297; 5,094,938; 5,104,783; 5,178,993; 5,813,729; 5,187,057; 5,192,651; 5,200,305 5,202,224; 5,206,130; 5,208,141; 5,210,011; 5,215,871; 5,223,386; 5,227,287; 5,256,526; 5,258,270; 5,272,051; 5,306,610; 5,326,682; 5,366,856; 5,378,596; 5,380,638; 5,382,502; 5,384,236; 5,397,691; 5,415,990; 5,434,034; 5,441,863; EPO 0 246 616; EPO 0 250 201; EPO 0 271 323; EPO 0 295 632; EPO 0 307 927; EPO 0 333 185; EPO 0 378 898; EPO 0 389 817; EPO 0 487 111; EPO 0 488 248; EPO 0 539 034; EPO 0 545 300; EPO 0 556 700; EPO 0 556 777; EPO 0 556 858; EPO 0 569 979; EPO 0 608 133; EPO 0 636 936; EPO 0 651 286; EPO 0 690 344; German OLS 4,026,903; German OLS 3,624,777. and German OLS 3,823,049. Typically such couplers are phenols, naphthols, or pyrazoloazoles.

Couplers that form magenta dyes upon reaction with oxidized color developing agent are described in such representative patents and publications as: "Farbkuppler-eine Literature Ubersicht," published in Agfa Mitteilungen, Band III, pp. 126–156 (1961) as well as U.S. Pat. NoS. 2,311,082 and 2,369,489; 2,343,701; 2,600,788; 2,908,573; 3,062,653; 3,152,896; 3,519,429; 3,758,309; 3,935,015; 4,540,654; 4,745,052; 4,762,775; 4,791,052; 4,812,576; 4,835,094; 4,840,877; 4,845,022; 4,853,319; 4,868,099, 4,865,960; 4,871,652; 4,876,182; 4,892,805; 4,900,657; 4,910,124; 4,914,013; 4,921,968; 4,929,540; 4,933,465; 4,942,116; 4,942,117; 4,942,118; U.S. Pat. No. 4,959,480; 4,968,594; 4,988,614; 4,992,361; 5,002,864; 5,021,325; 5,066,575; 5,068,171; 5,071,739; 5,100,772; 5,110,942; 5,116,990; 5,118,812; 5,134,059; 5,155,016; 5,183,728; 5,234,805; 5,235,058; 5,250,400; 5,254,446; 5,262,292; 5,300,407; 5,302,496; 5,336,593; 5,350,667; 5,395,968; 5,354,826; 5,358,829; 5,368,998; 5,378,587; 5,409,808; 5,411,841; 5,418,123; 5,424,179; EPO 0 257 854; EPO 0 284 240; EPO 0 341 204; EPO 347,235; EPO 365,252; EPO 0 422 595; EPO 0 428 899; EPO 0 428 902; EPO 0 459 331; EPO 0 467 327; EPO 0 476 949; EPO 0 487 08 1; EPO 0 489 333; EPO 0 512 304; EPO 0 515 128; EPO 0 534 703; EPO 0 554 778; EPO 0 558 145; EPO 0 571 959; EPO 0 583 832; EPO 0 583 834; EPO 0 584 793; EPO 0 602 748; EPO 0 602 749; EPO 0 605 918; EPO 0 622 672; EPO 0 622 673; EPO 0 629 912; EPO 0 646 841, EPO 0 656 561; EPO 0 660 177; EPO 0 686 872; WO 90/10253; WO 92/09010; WO 92/10788; WO 92/12464; WO 93/01523; WO 93/02392; WO 93/02393; WO 93/07534; UK Application 2,244,053; Japanese Application 03192-350; German OLS 3,624,103; German OLS 3,912,265; and German OLS 40 08 067. Typically such couplers are pyrazolones, pyrazoloazoles, or pyrazolobenzimidazoles that form magenta dyes upon reaction with oxidized color developing agents.

Couplers that form yellow dyes upon reaction with oxidized color developing agent are described in such representative patents and publications as: "Farbkuppler-eine Literature Ubersicht," published in Agfa Mitteilungen; Band III; pp. 112–126 (1961); as well as U.S. Pat. Nos. 2,298,443; 2,407,210; 2,875,057; 3,048,194; 3,265,506; 3,447,928; 4,022,620; 4,443,536; 4,758,501; 4,791,050; 4,824,771; 4,824,773; 4,855,222; 4,978,605; 4,992,360; 4,994,361; 5,021,333; 5,053,325, 5,066,574; 5,066,576; 5,100,773; 5,118,599; 5,143,823; 5,187,055; 5,190,848; 5,213,958; 5,215,877; 5,215,878; 5,217,857; 5,219,716; 5,238,803;

5,283,166; 5,294,531; 5,306,609; 5,328,818; 5,336,591; 5,338,654; 5,358,835; 5,358,838; 5,360,713; 5,362,617; 5,382,506; 5,389,504; 5,399,474; 5,405,737; 5,411,848; 5,427,898; EPO 0 327 976; EPO 0 296 793; EPO 0 365 282; EPO 0 379 309; EPO 0 415 375; EPO 0 437 818; EPO 0 447 969; EPO 0 542 463; EPO 0 568 037; EPO 0 568 196; EPO 0 568 777; EPO 0 570 006; EPO 0 573 761; EPO 0 608 956; EPO 0 608 957; and EPO 0 628 865. Such couplers are typically open chain ketomethylene compounds.

Couplers that form colorless products upon reaction with oxidized color developing agent are described in such representative patents as: UK. 861,138; U.S. Pat. Nos. 3,632, 345; 3,928,041; 3,958,993 and 3,961,959. Typically such couplers are cyclic carbonyl containing compounds that form colorless products on reaction with an oxidized color developing agent.

Couplers that form black dyes upon reaction with oxidized color developing agent are described in such representative patents as U.S. Pat. Nos. 1,939,231; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151, 343, and 5,234,800.

It may be useful to use a combination of couplers any of which may contain known ballasts or coupling-off groups such as those described in U.S. Pat. No. 4,301,235; U.S. Pat. No. 4,853,319 and U.S. Pat. No. 4,351,897. The coupler may contain solubilizing groups such as described in U.S. Pat. No. 4,482,629. The coupler may also be used in association with "wrong" colored couplers (e.g. to adjust levels of interlayer correction) and, in color negative applications, with masking couplers such as those described in EP 213.490; Japanese Published Application 58-172,647; U.S. Pat. Nos. 2,983,608; 4,070,191; and 4,273,861; German Applications DE 2,706,117 and DE 2,643,965; UK. Patent 1,530,272; and Japanese Application 58-1 13935. The masking couplers may be shifted or blocked, if desired.

Typically, couplers are incorporated in a silver halide emulsion layer in a mole ratio to silver of 0.05 to 1.0 and generally 0.1 to 0.5. Usually the couplers are dispersed in a high-boiling organic solvent in a weight ratio of solvent to coupler of 0.1 to 10.0 and typically 0.1 to 2.0 although dispersions using no permanent coupler solvent are sometimes employed.

The invention materials may be used in association with materials that release Photographically Useful Groups (PUGS) that accelerate or otherwise modify the processing steps e.g. of bleaching or fixing to improve the quality of the image. Bleach accelerator releasing couplers such as those described in EP 193,389; EP 301,477; U.S. Pat. No. 4,163, 669; U.S. Pat. No. 4,865,956; and U.S. Pat. No. 4,923,784, may be useful. Also contemplated is use of the compositions in association with nucleating agents, development accelerators or their precursors (UK Patent 2,097,140; UK. Patent 2,131,188); electron transfer agents (U.S. Pat. No. 4,859, 578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention materials may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. No. 4,420,556; and U.S. Pat. No. 4,543, 323.) Also, the compositions may be blocked or coated in protected form as described, for example, in Japanese Application 61/258,249 or U.S. Pat. No. 5,019,492.

The invention materials may further be used in combination with image-modifying compounds that release PUGS such as "Developer Inhibitor-Releasing" compounds (DIR's). DIR's useful in conjunction with the compositions of the invention are known in the art and examples are described in U.S. Pat. Nos. 3,137,578; 3,148,022; 3,148, 062; 3,227,554; 3,384,657; 3,379,529; 3,615,506; 3,617, 291; 3,620,746; 3,701,783; 3,733,201; 4,049,455; 4,095, 984; 4,126,459; 4,149,886; 4,150,228; 4,211,562; 4,248, 962; 4,259,437; 4,362,878; 4,409,323; 4,477,563; 4,782, 012; 4,962,018; 4,500,634; 4,579,816; 4,607,004; 4,618, 571; 4,678,739; 4,746,600; 4,746,601; 4,791,049; 4,857, 447; 4,865,959; 4,880,342; 4,886,736; 4,937,179; 4,946, 767; 4,948,716; 4,952,485; 4,956,269; 4,959,299; 4,966, 835; 4,985,336 as well as in patent publications GB 1,560, 240; GB 2,007,662; GB 2,032,914; GB 2,099,167; DE 2,842,063, DE 2,937,127; DE 3,636,824; DE 3,644,416 as well as the following European Patent Publications: 272, 573; 335,319; 336,411; 346, 899; 362, 870; 365,252;365, 346; 373,382; 376,212; 377,463; 378,236; 384,670; 396, 486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science and Engineering,* Vol. 13, p. 174 (1969), incorporated herein by reference. Generally, the developer inhibitor-releasing (DIR) couplers include a coupler moiety and an inhibitor coupling-off moiety (IN). TIhe inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzirnidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

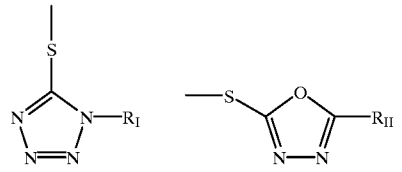

-continued

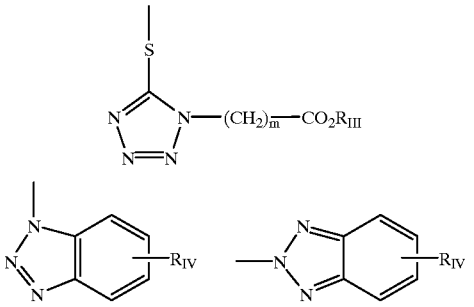

wherein $R_I$ is selected from the group consisting of straight and branched alkyls of from 1 to about 8 carbon atoms, benzyl, phenyl, and alkoxy groups and such groups containing none, one or more than one such substituent, $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color, as one associated with a different film layer. It may also be useful that the coupler moiety included in the developer inhibitor-releasing coupler forms colorless products and/or products that wash out of the photographic material during processing (so-called "universal" couplers).

A compound such as a coupler may release a PUG directly upon reaction of the compound during processing, or indirectly through a timing or linking group. A timing group produces the time-delayed release of the PUG such groups using an intramolecular nucleophilic substitution reaction (U.S. Pat. No. 4,248,962); groups utilizing an electron transfer reaction along a conjugated system (U.S. Pat. Nos. 4,409,323; 4,421,845; 4,861,701, Japanese Applications 57-188035; 58-98728; 58-209736; 58-209738); groups that function as a coupler or reducing agent after the coupler reaction (U.S. Pat. No. 4,438,193; U.S. Pat. No. 4,618,571) and groups that combine the features describe above. It is typical that the timing group is of one of the formulas:

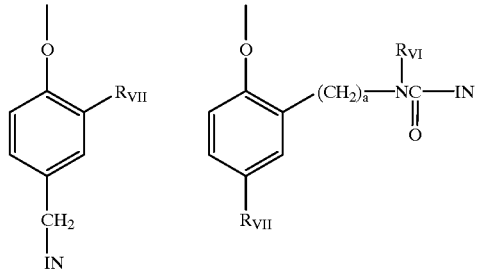

wherein IN is the inhibitor moiety, $R_{VII}$ is selected from the group consisting of nitro, cyano, alkylsulfonyl; sulfamoyl; and sulfonamido groups; a is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

The timing or linking groups may also function by electron transfer down an unconjugated chain. Linking groups are known in the art under various names. Often they have been referred to as groups capable of utilizing a hemiacetal or iminoketal cleavage reaction or as groups capable of utilizing a cleavage reaction due to ester hydrolysis such as U.S. Pat. No. 4,546.073. This electron transfer down an unconjugated chain typically results in a relatively fast decomposition and the production of carbon dioxide, formaldehyde, or other low molecular weight by-products. The groups are exemplified in EP 464,612, EP 523,451, U.S. Pat. No. 4,146,396, Japanese Kokai 60-249148 and 60-249149.

It is also contemplated that the concepts of the present invention may be employed to obtain reflection color prints as described in *Research Disclosure,* November 1979, Item 18716, available from Kenneth Mason Publications, Ltd, Dudley Annex, 12a North Street, Emsworth, Hampshire P0101 7DQ, England, incorporated herein by reference. Materials of the invention may be coated on pH adjusted support as described in U.S. Pat. No. 4,917,994; on a support with reduced oxygen permeability (EP 553,339); with epoxy solvents (EP 164,961); with nickel complex stabilizers (U.S. Pat. No. 4,346,165; U.S. Pat. No. 4,540,653 and U.S. Pat. No. 4,906,559 for example); with ballasted chelating agents such as those in U.S. Pat. No. 4,994,359 to reduce sensitivity to polyvalent cations such as calcium; and with stain reducing compounds such as described in U.S. Pat. No. 5,068,171. Other compounds useful in combination with the invention are disclosed in Japanese Published Applications described in Derwent Abstracts having accession numbers as follows: 90-072,629, 90-072,630; 90-072,631; 90-072,632; 90-072,633; 90-072,634; 90-077,822; 90-078,229; 90-078,230; 90-079,336; 90-079,337; 90-079,338; 90-079,690; 90-079,691; 90-080,487; 90-080,488; 90-080,489; 90-080,490; 90-080,491; 90-080,492; 90-080,494; 90-085,928; 90-086,669; 90-086,670; 90-087,360; 90-087,361; 90-087,362; 90-087,363; 90-087,364; 90-088,097; 90-093,662; 90-093,663; 90-093,664; 90-093,665; 90-093,666; 90-093,668; 90-094,055; 90-094,056; 90-103,409; 83-62,586; 83-09,959.

Conventional radiation-sensitive silver halide emulsions can be employed in the practice of this invention. Such emulsions are illustrated by *Research Disclosure,* Item 38755, September 1996, I. Emulsion grains and their preparation.

Especially useful in this invention are tabular grain silver halide emulsions. Tabular grains are those having two parallel major crystal faces and having an aspect ratio of at least 2. The term "aspect ratio" is the ratio of the equivalent circular diameter (ECD) of a orain major face divided by its thickness (t). Tabular grain emulsions are those in which the tabular grains account for at least 50 percent (preferably at least 70 percent and optimally at least 90 percent) of the total grain projected area. Preferred tabular grain emulsions are those in which the average thickness of the tabular grains is less than 0.3 micrometer (preferably thin—that is, less than 0.2 micrometer and most preferably ultrathin—that is, less than 0.07 micrometer). The major faces of the tabular grains can lie in either {111} or {100} crystal planes. The mean ECD of tabular grain emulsions rarely exceeds 10 micrometers and more typically is less than 5 micrometers.

In their most widely used form tabular grain emulsions are high bromide {111} tabular grain emulsions. Such emulsions are illustrated by Kofron et al U.S. Pat. No. 4,439,520, Wilgus et al U.S. Pat. No. 4,434,226. Solberg et al U.S. Pat. No. 4,433,048. Maskasky U.S. Pat. Nos. 4,435, 501, 4,463,087 and 4,173,320, Daubendiek et al U.S. Pat. Nos. 4,414,310 and 4,914,014, Sowinski et al U.S. Pat. No. 4,656,122, Piggin et al U.S. Pat. Nos. 5,061,616 and 5,061,609, Tsaur et al U.S. Pat. Nos. 5,147,771, '772, '773, 5,171,659 and 5,252,453, Black et al U.S. Pat. Nos. 5,219,720 and 5,334,495, Delton U.S. Pat. Nos. 5.310,644, 5,372,927 and 5,460,934, Wen U.S. Pat. No. 5,470,698, Fenton et al U.S. Pat. No. 5,476,760, Eshelman et al U.S. Pat. Nos. 5,612,175 and 5,614,359, and Irving et al U.S. Pat. No. 5,667,954.

Ultrathin high bromide {111} tabular grain emulsions are illustrated by Daubendiek et al U.S. Pat. Nos. 4,672,027, 4,693,964, 5,494,789, 5,503,971 and 5,576.168, Antoniades et al U.S. Pat. No. 5,250,403, Olm et al U.S. Pat. No. 5,503,970, Deaton et al U.S. Pat. No. 5,582,965, and Maskasky U.S. Pat. No. 5,667,955.

High bromide {100} tabular grain emulsions are illustrated by Mignot U.S. Pat. Nos. 4,386,156 and 5,386,156.

High chloride {111} tabular grain emulsions are illustrated by Wey U.S. Pat. No. 4,399,215. Wey et al U.S. Pat. No. 4,414,306, Maskasky U.S. Pat. Nos. 4,400,463, 4,713,323, 5,061,617, 5,178,997, 5,183,732, 5,185,239, 5,399,478 and 5,411,852, and Maskasky et al U.S. Pat. Nos. 5,176,992 and 5,178,998. Ultrathin high chloride {111} tabular grain emulsions are illustrated by Maskasky U.S. Pat. Nos. 5,271,858 and 5,389,509.

High chloride {100} tabular grain emulsions are illustrated by Maskasky U.S. Pat. Nos. 5,264,337, 5,292,632, 5,275,930 and 5,399,477, House et al U.S. Pat. No. 5,320,938, Brust et al U.S. Pat. No. 5,314,798, Szajewski et al U.S. Pat. No. 5,356,764, Chang et al U.S. Pat. Nos. 5,413,904 and 5,663,041, Oyamada U.S. Pat. No. 5,593,821, Yamashita et al U.S. Pat. Nos. 5,641,620 and 5,652,088, Saitou et al U.S. Pat. No. 5,652,089, and Oyamada et al U.S. Pat. No. 5,665,530. Ultrathin high chloride {100} tabular grain emulsions can be prepared by nucleation in the presence of iodide, following the teaching of House et al and Chang et al, cited above.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent. Tabular grain emulsions of the latter type are illustrated by Evans et al. U.S. Pat. No. 4,504,570.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye. If desired "Redox Amplification" as described in Research Disclosure XVIIIB(5) may be used.

With negative-working silver halide, the processing step described above provides a negative image. One type of such element, referred to as a color negative film, is designed for image capture. Speed (the sensitivity of the element to low light conditions) is usually critical to obtaining sufficient image in such elements. Such elements are typically silver bromoiodide emulsions coated on a transparent support and may be processed, for example, in known color negative processes such as the Kodak C-41 process as described in The British Journal of Photography Annual of 1988, pages 191–198. If a color negative film element is to be subsequently employed to generate a viewable projection print as for a motion picture, a process such as the Kodak ECN-2 process described in the H-24 Manual available from EFastman Kodak Co. may be employed to provide the color negative image on a transparent support. Color negative development times are typically 3'15" or less and desirably 90 or even 60 seconds or less.

The photographic element of the invention can be incorporated into exposure structures intended for repeated use or exposure structures intended for limited use, variously referred to by names such as "single use cameras", "lens with film", or "photosensitive material package units".

Another type of color negative element is a color print. Such an element is designed to receive an image optically printed from an image capture color negative element. A color print element may be provided on a reflective support for reflective viewing (e.g. a snap shot) or on a transparent support for projection viewing as in a motion picture. Elements destined for color reflection prints are provided on a reflective support, typically paper, employ silver chloride emulsions, and may be optically printed using the so-called negative-positive process where the element is exposed to light through a color negative film which has been processed as described above. The element is sold with instructions to process using a color negative optical printing process, for example the Kodak RA-4 process, as generally described in PCT WO 87/04534 or U.S. Pat. No. 4,975,357, to form a positive image. Color projection prints may be processed, for example, in accordance with the Kodak ECP-2 process as described in the H-24 Manual. Color print development times are typically 90 seconds or less and desirably 45 or even 30 seconds or less.

A reversal element is capable of forming a positive image without optical printing. To provide a positive (or reversal) image, the color development step is preceded by development with a non-chromogenic developing agent to develop exposed silver halide, but not form dye, and followed by uniformly fogging the element to render unexposed silver halide developable. Such reversal emulsions are typically sold with instructions to process using a color reversal process such as the Kodak E-6 process as described in The British Journal of Photography Annual of 1988, page 194. Alternatively, a direct positive emulsion can be employed to obtain a positive image.

The above elements are typically sold with instructions to process using the appropriate method such as the mentioned color negative (Kodak C-41), color print (Kodak RA-4), or reversal (Kodak F-6) process.

Preferred color developing agents are p-phenylenediamines such as:

4-amino-N,N-diethylaniline hydrochloride.

4-amino-3-methyl-N,N-diethylaniline hydrochloride, 4-amino-3-methyl-N-ethyl-N-(2-methanesulfonamidoethyl)aniline sesquisulfate hydrate, 4-amino-3-methyl-N-ethyl-N-(2-hydroxyethyl)aniline sulfate.

4-amino-3-(2-methanesulfonamidoethyl)-N,N-diethylaniline hydrochloride, and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

The entire contents of the patents and other publications referred to in this specification are incorporated herein by reference.
The following examples further illustrate the couplers of the invention. The invention is not limited however to these examples.
M-1
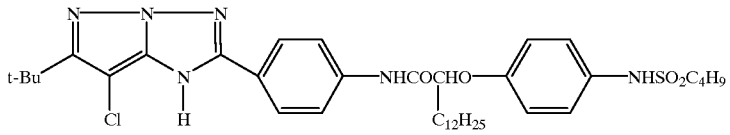
M-2
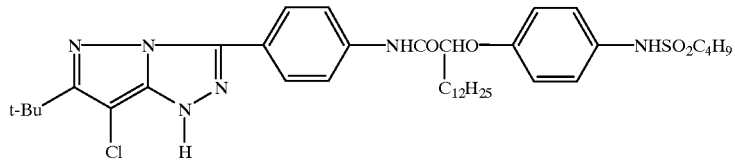
M-3
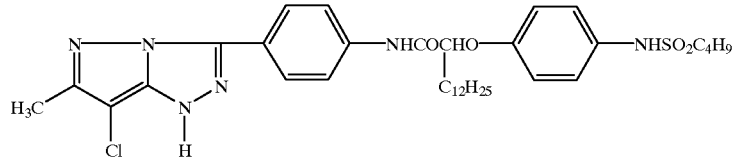
M-4
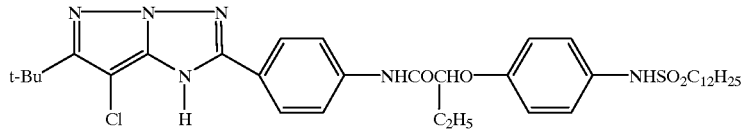
M-5
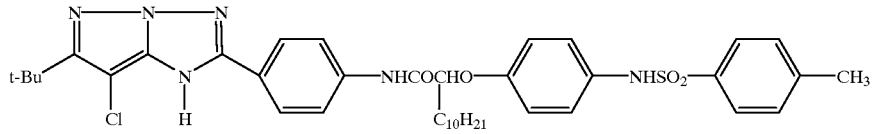
M-6
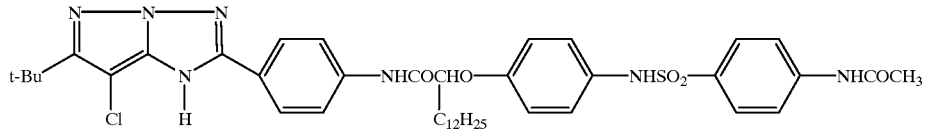
M-7
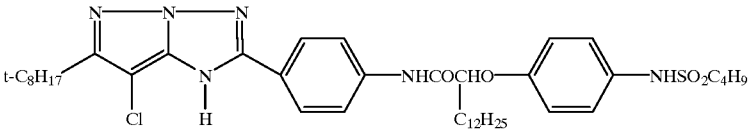
M-8
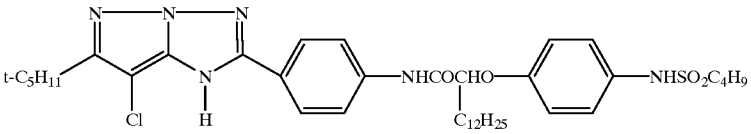

-continued
M-9
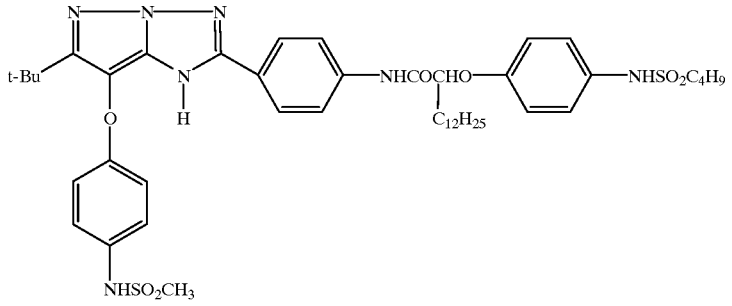
M-10
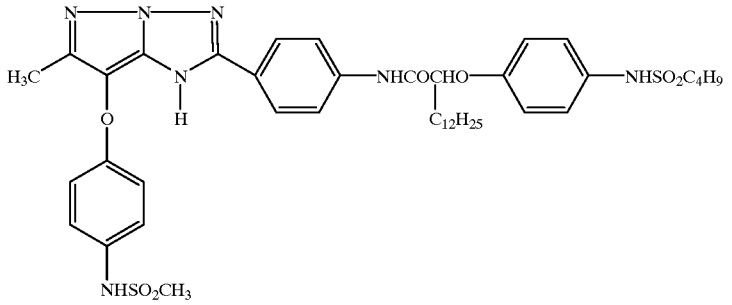
M-11
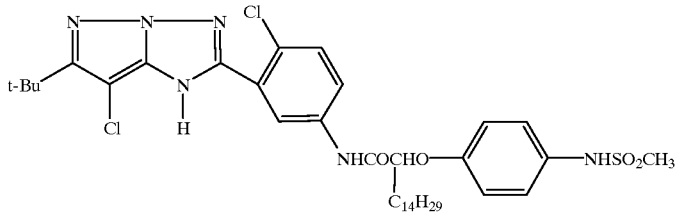
M-12
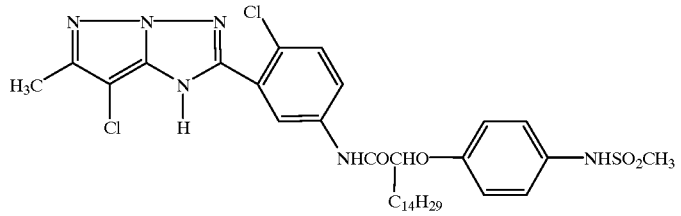
M-13
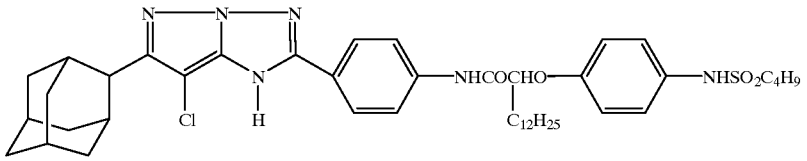
M-14
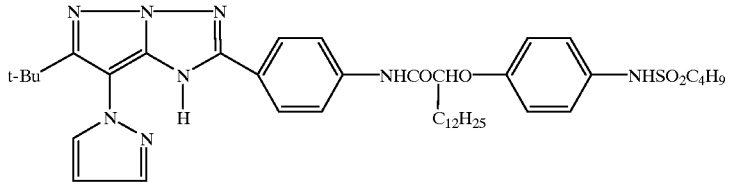

-continued
M-15
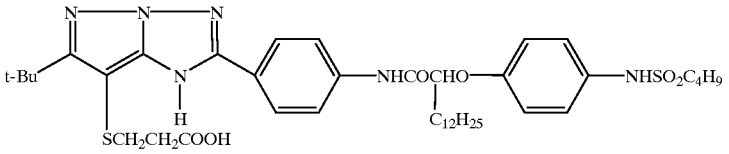
M-16
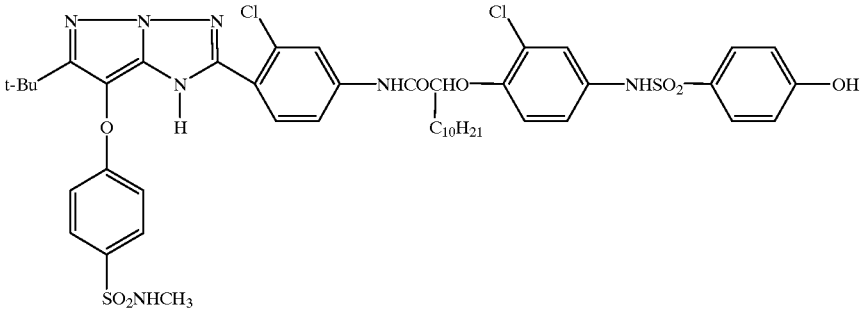
M-17
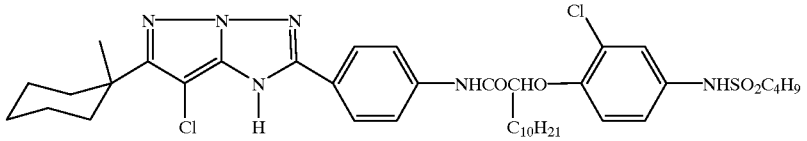
M-18
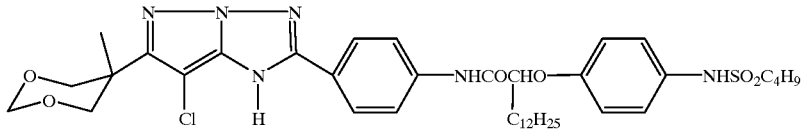
M-19
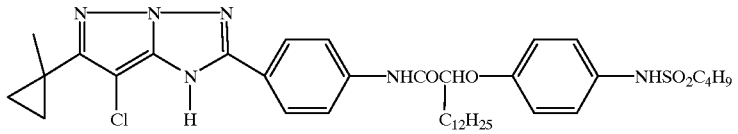
M-20
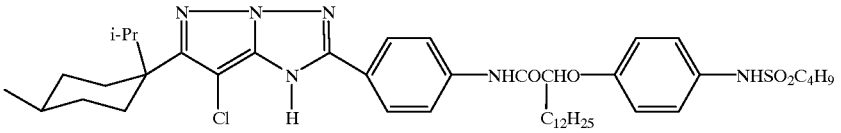
M-21
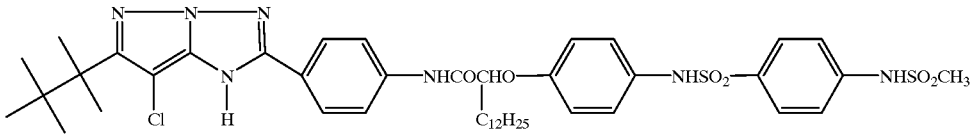
M-22
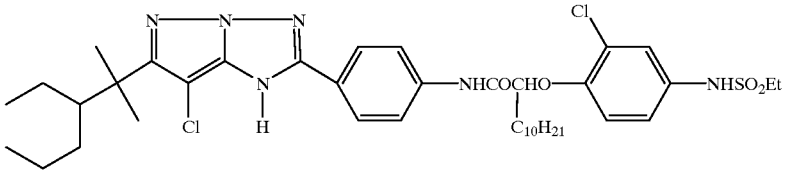

-continued
M-23
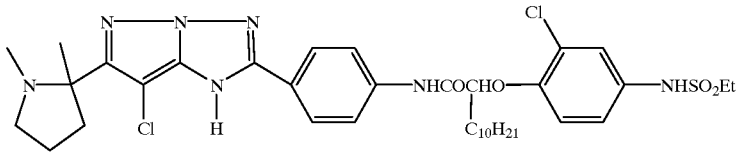
M-24
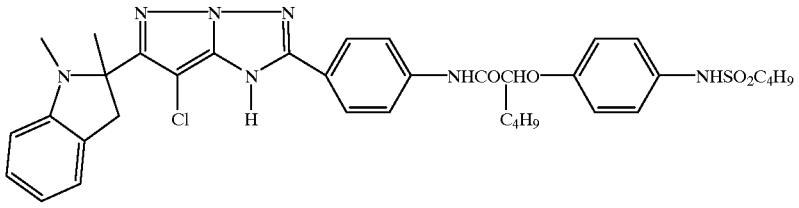
M-25
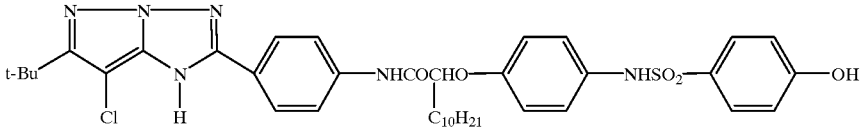
M-26
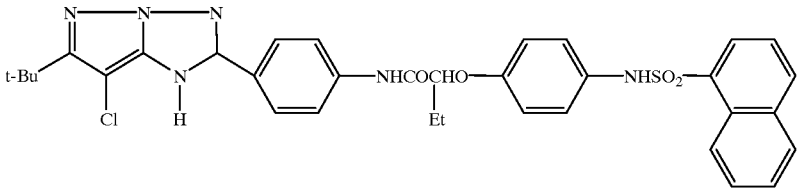
M-27
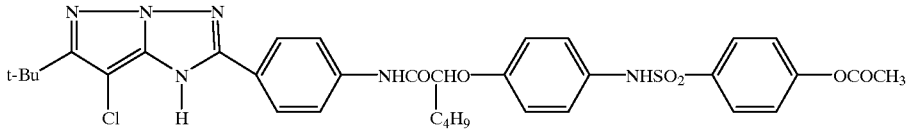
M-28
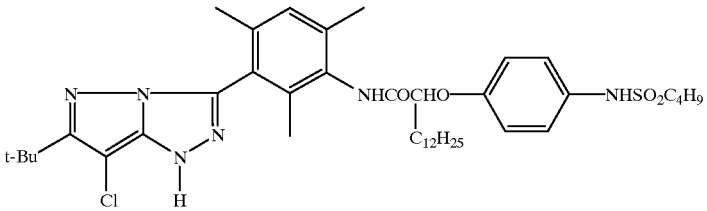
A typical and useful method for synthesizing the coupler compounds of the invention is described hereinafter.
COUPLER SYNTHESIS
The following synthetic example is a useful method for preparing coupler M-1 of this invention. Other couplers of the invention can be prepared by the same general procedure.
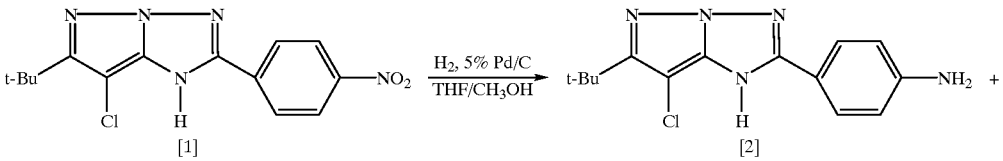

-continued

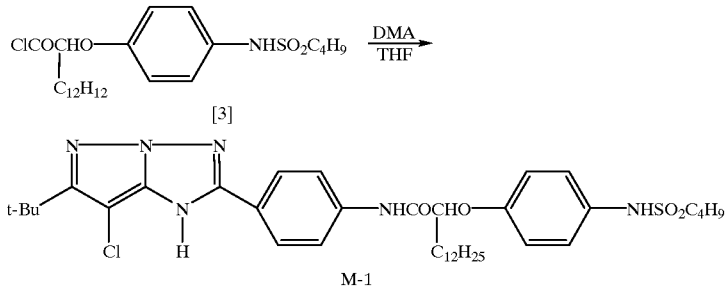

2-(4-Aminophenyl)-6-tert-butyl-7-chloro-1H-pyrazolo[1.5] 1.2,4]triazole [2]

A suspension of 3.0 (g (9.39 mmol) of 6-tert-butyl-7-chloro-2-(4-nitrophenyl)-1H-pyrazolo[1,5-b]1,2,4]triazole [1] in 100 mL of tetrahydrofuran (THF) and 350 mL of $CH_3OH$ was reduced at room temperature under 50 p.s.i. of $H_2$ using 5% Pd/C as the catalyst. The reduction was complete after stirring for 3 hours as shown by TLC analysis. The catalyst was filtered off and the solvent was removed in vcacuo to yield a white solid, which was washed with ligroin and dried. Yield 2.65 g (91.5%).

6-tert-Butyl-2-[2-(4-(butylsulfonylamino)phenoxy) tetradecanamido]-7-chloro-1H-pyrazolo[1.5-b]1,2,4] triazole (M-1)

To a solution of 2.65 g (9.10 mmol) of [2] and 1.22 g (10 mmol) of N,N-dimethylaniline in 50 ml, of THF cooled at ca. 0° C. was added dropwise a solution of 2-(4-butylsulfonylamino)phenoxytetradecanoyl chloride in 20 mL of THF. After the addition had been complete the reaction mixture was warmed to room temperature and stirred overnight. TLC analysis indicated that the reaction was complete (system: EtOAc/ligroin:1/1). Aqueous work-up followed by drying in vacuo afforded a white solid which was further purified by trituration in ligroin containing 5% v/v of ethyl acetate. The weight of the dried solid was 5.62 g (85%). All of the analytical data confirmed the assigned structure for coupler M-1.

A number of photographic elements, designated as elements 101–107 and 201–202, have been prepared for testing and comparison of couplers M-1 and M-28 of the invention and comparative couplers C-1 through C-7. Structures of the comparative couplers and of stabilizers, ST-1 and ST-2, used in preparing the photographic elements are as follows:

C-1

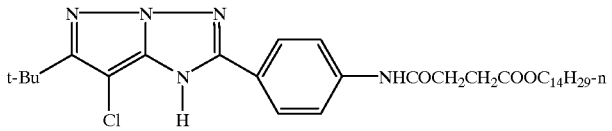

C-2

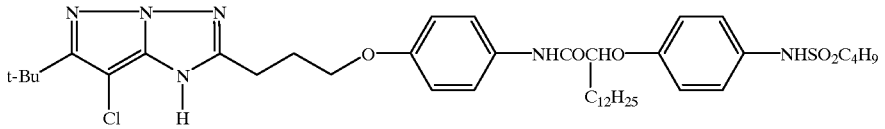

C-3

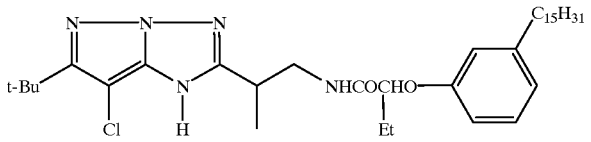

C-4

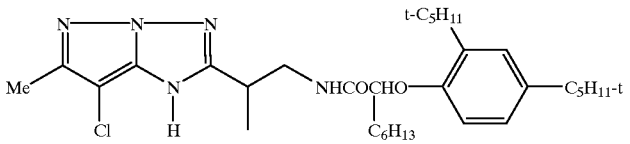

C-5

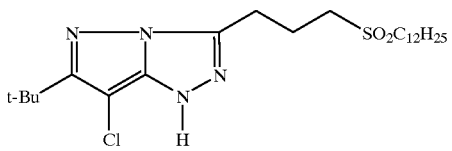

-continued

C-6

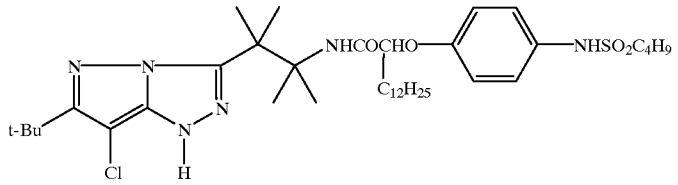

C7

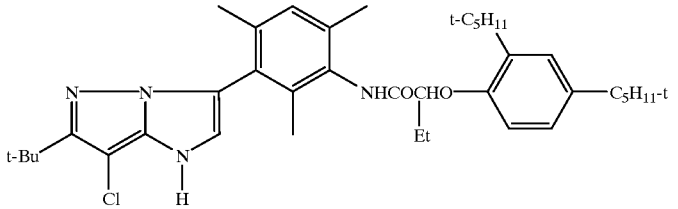

ST-1

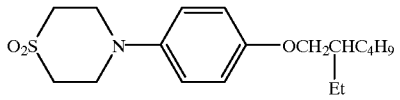

ST-2

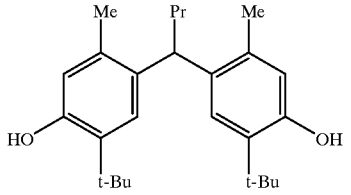

Preparation of the Photographic Dispersions for Elements 101–107

Coupler M-1, stabilizers ST-1 and ST-2, and coupler solvents dibutyl phthalate and diundecyl phthalate were dispersed in aqueous gelatin in the following manner. Coupler M-1 (0.705 g, $9.69\times10^{-4}$ mole), stabilizer ST-1 (0.284 g, $8.36\times10^{-4}$ mole) and stabilizer S-2 (0.284 g, $7.423\times10^{-4}$ mole) were dissolved in a mixture of dibutyl phthalate (0.425 g), bis(2-ethylhexyl) phthalate (0.425 g) and ethyl acetate (2.144 g). The mixture was heated to effect solution. After adding a solution of aqueous gelatin (22.00 g, 11.60%), surfactant diisopropylnaphthalenie sulfonic acid (sodium salt)(2.55 g 10% solution), and water to make a total of 42.53 grams, the mixture was dispersed by passing it three times through a Gaulin homogenizer. This dispersion was used in the preparation of photographic element 101.

Dispersions containing the comparison couplers C-1 through C-6 shown for elements 102–107 in Table 1 below were prepared in a similar manner. The amount of coupler in each dispersion was $9.69\times10^{-5}$ mole, and other components were the same as in element 101.

Preparation of the Photographic Dispersions for Elements 201 and 202

Coupler M-28, stabilizers ST-1 and ST-2, and coupler solvent tricresyl phosphate were dispersed in aqueous gelatin in the following manner. Coupler M-28 (0.726 g, $9.43\times10^{-4}$ mole), stabilizer ST-1 (0.332 g) and stabilizer ST-2 (0.332 g) were dissolved in tricresyl phosphate (1.451 g), and ethyl acetate (2.177 g). The mixture was heated to effect solution. After adding a solution of aqueous gelatin (22.00 g, 11.60%), surfactant diisopropylnaphthalene sulfonic acid (sodium salt) (2.55 g 10% solution), and water to make a total of 42.53 grams, the mixture was dispersed by passing it three times through a Gaulin homogenizer. This dispersion was used in the preparation of photographic element 201.

Comparison coupler C-7, stabilizers ST-1 and ST-2, and coupler solvent tricresyl phosphate were dispersed in aqueous gelatin in the following manner. Coupler C-7 (0.726 g, $9.43\times10^{-4}$ mole), stabilizer ST-1 (0.332 g) and stabilizer ST-2 (0.332 g) were dissolved in tricresyl phophate (1.451 g), and ethyl acetate (2.177 g). The mixture was heated to effect solution. After adding a solution of aqueous gelatin (21.26 g, 11.54%), surfactant diisopropylnaphthalene sulfonic acid (sodium salt) (2.47 g 10% solution), and water to make a total of 41.08 grams, the mixture was dispersed by passing it three times through a Gaulin homogenizer. This dispersion was used in the preparation of photographic element 202.

Preparation of the Photographic Elements

On a gel-subbed, polyethylene-coated paper support were coated the following layers:

First Layer

A underlayer containing 3.23 grams gelatin per square meter.

Second Layer

A photosensitive layer containing (per square meter) 2.15 grams total gelatin, an amount of green-sensitized silver chloride emulsion containing 0.172 grams silver; the dispersion containing $6.13\times10^{-4}$ mole (elements 101–107) or $4.728\times10^{-4}$ (elements 201–202) of the coupler indicated in Table 1; and 0.043 grams of surfactant diisopropylnaphthalene sulfonic acid (sodium salt) (in addition to the surfactant used to prepare the coupler dispersion).

Third Layer

A protective layer containing (per square meter) 1.40 grams gelatin, 0.15 gram bis(vinylsulfonyl)methyl ether, 0.043 gram of surfactant diisopropylnaphthalene sulfonic acid (sodium salt), and $4.40\times10^{-6}$ gram of surfactant tetraethylammonium perfluorooctanesulfonate.

TABLE 1

| Element | Comparison or Invention | Coupler |
|---|---|---|
| 101 | Invention | M-1 |
| 102 | Comparison | C-1 |
| 103 | Comparison | C-2 |
| 104 | Comparison | C-3 |
| 105 | Comparison | C-4 |
| 106 | Comparison | C-5 |
| 107 | Comparison | C-6 |
| 201 | Invention | M-28 |
| 202 | Comparison | C-7 |

Preparation of Processed Photographic Elements

Processed samples were prepared by exposing each of the coated photographic elements 101–108 and 201–202 through a step wedge and processing as follows:

| Process Step | Time (min.) | Temp. (C.) |
|---|---|---|
| Developer | 0.75 | 35.0 |
| Bleach-Fix | 0.75 | 35.0 |
| Water wash | 1.50 | 35.0 |

The processing solutions used in the above process had the following compositions (amounts per liter of solution):

| Developer | |
|---|---|
| Triethanolamine | 12.41 g |
| Blankophor REU (trademark of Mobay Corp.) | 2.30 g |
| Lithium polystyrene sulfonate | 0.09 g |
| N,N-Diethylhydroxylamine | 4.59 g |
| Lithium sulfate | 2.70 g |
| Developing agent (Dev-1) | 5.00 g |
| 1-Hydroxyethyl-1,1-diphosphonic acid | 0.49 g |
| Potassium carbonate, anhydrous | 21.16 g |
| Potassium chloride | 1.60 g |
| Potassium bromide | 7.00 mg |
| pH adjusted to 10.4 at 26.7 C. | |
| **Bleach-Fix** | |
| Solution of ammonium thiosulfate | 71.85 g |
| Ammonium sulfite | 5.10 g |
| Sodium metabisulfite | 10.00 g |
| Acetic acid | 10.20 g |
| Ammonium ferric ethylenediaminetetra acetate | 48.58 g |
| Ethylenediaminetetraacetic acid | 3.86 g |
| pH adjusted to 6.7 at 26.7 C. | |

Dev-1

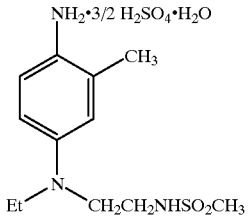

The density of each step of each strip was measured. The maximum and minimum density of each strip (Dmax and Dmin) and the contrast were determined. Contrast was determined as the slope of a line connecting two points, A and B, on a plot of density vs the logarithm of exposure (logE). A is the density at the point at which logE is 0.3 less than that required to produce a density of 1.0, and B is the density at the point at which logE is 0.3 more than that required to produce a density of 1.0; that is, Contrast=$(D_B-D_A)/0.6$. The results are recorded in Table 2.

TABLE 2

| Element | Coupler | Dmax | Dmin | Contrast |
|---|---|---|---|---|
| 101 | M-1 | 2.76 | 015 | 3.69 |
| 102 | C-1 | 2.54 | 0.14 | 3.52 |
| 103 | C-2 | 2.70 | 0.13 | 3.32 |
| 104 | C-3 | 2.63 | 0.13 | 3.51 |
| 105 | C-4 | 2.61 | 0.15 | 3.52 |
| 106 | C-5 | 2.53 | 0.13 | 3.42 |
| 107 | C-6 | 2.69 | 0.13 | 2.91 |
| 201 | M-28 | 1.89 | 0.10 | 1.84 |
| 202 | C-7 | 1.78 | 0.09 | 1.77 |

The data in the above table demonstrate the advantages of the invention. The data show that the couplers of the invention (M-1 and M-28) provided significantly better coupling efficiency, as indicated by higher Dmax and contrast, than the comparative couplers when tested in dispersions prepared in the same manner.

This invention has been described in detail with particular reference to certain preferred embodiments thereof; but it will be understood that variations and modifications can be effected within the spirit and scope of the invention.

What is claimed is:

1. A photographic element comprising a support bearing at least one photographic silver halide emulsion layer having associated therewith a dye-forming coupler of the formula:

(I)

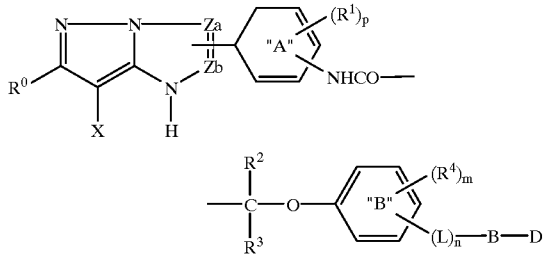

wherein:

$Z_a$ is —N=and $Z_b$ is

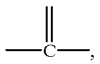

to which ring "A" is directly attached;

$R^0$ represents a methyl or t-butyl group;

$R^1$, $R^2$, $R^3$ and $R^4$ independently represent hydrogen or substituents, provided that any two $R^1$ groups, any two $R^4$ groups or $R^2$ and $R^3$ may form a ring;

L represents a divalent linking group;

B represents a substituted or unsubstituted sulfonamido or sulfamoyl group;

D represents a substituted or unsubstituted alkyl, aryl, carbocyclic or heterocyclic group;

X represents hydrogen or a coupling-off group;

p and m independently represent integers from 0 to 4; and n represents 0 or 1.

2. A photographic element as in claim 1 wherein $R^0$ is t-butyl.

3. A photographic element as in claim 1 wherein B is —$N(R^5)SO_2$— where $R^5$ is hydrogen or a substituent; D is lower alkyl, phenyl, alkylsulfonamidophenyl or p-hydroxyphenyl; $R^1$ is hydrogen, alkyl, aryl, alkoxy or halogen; $R^2$ is hydrogen; $R^3$ is alkyl; $R^4$ is hydrogen, alkyl, aryl, alkoxy or halogen or two $R^4$ groups on adjacent positions represent a fused benzene ring; p and m, independently are 0 or 1; and x is chlorine or aryloxy.

4. A photographic element as in claim 1 wherein $R^0$ is methyl.

5. A photographic element as in claim 1 wherein B is —$NHSO_2$—D is butyl or p-alkylsulfonamidophenyl, $R^1$ is hydrogen or halogen; $R^2$ is hydrogen, $R^3$ is alkyl, and $R^4$ is hydrogen or halogen.

6. A photographic element as in claim 5 where in $R^0$ is t-butyl.

7. A photographic element as in claim 1 wherein said coupler is of the formula

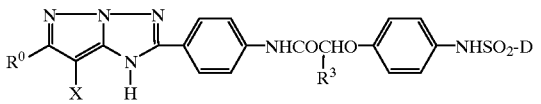

wherein X is halogen or aryloxy, $R_3$ is alkyl and D is lower alkyl or p-alkylsulfonamidophenyl.

8. A photographic element as in claim 7 wherein $R^0$ is butyl.

9. A photographic element as in claim 7 wherein $R^0$ is methyl.

10. The element of claim 1 wherein the coupler has the formula:

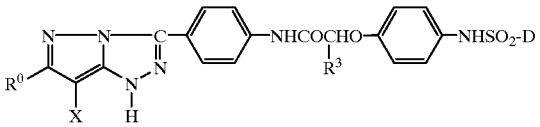

wherein $R^0$ is butyl, X is halogen or aryloxy, $R^3$ is alkyl of 2 to 14 carbon atoms and D is alkyl.

* * * * *

UNITED STATES PATENT AND TRADEMARK OFFICE

CERTIFICATE OF CORRECTION

PATENT NO. : 6,143,485
DATED : November 7, 2000
INVENTOR(S) : Ping-Wah Tang, Stanley W. Cowan It is certified that error appears in the above-identified patent and that said Letters Patent is hereby corrected as shown below:

Column 30,
Line 5, insert --t-- before "butyl".
Line 21, insert --t-- before "butyl".

Signed and Sealed this

Fourteenth Day of August, 2001

*Attest:*

Nicholas P. Godici

*Attesting Officer*

NICHOLAS P. GODICI
*Acting Director of the United States Patent and Trademark Office*